US011236413B2

(12) United States Patent
Rachiele et al.

(10) Patent No.: US 11,236,413 B2
(45) Date of Patent: Feb. 1, 2022

(54) COATED METAL SHEET HAVING AN AMINO ACID TO IMPROVE CORROSION RESISTANCE

(71) Applicant: ArcelorMittal, Luxembourg (LU)

(72) Inventors: Lydia Rachiele, Rombas (FR); Herve Derule, Montoy Flanville (FR); Delphine Thai, Bousse (FR)

(73) Assignee: ARCELORMITTAL, Luxembourg (LU)

( * ) Notice: Subject to any disclaimer, the term of this patent is extended or adjusted under 35 U.S.C. 154(b) by 14 days.

(21) Appl. No.: 16/653,183

(22) Filed: Oct. 15, 2019

(65) Prior Publication Data

US 2020/0040438 A1 Feb. 6, 2020

Related U.S. Application Data

(62) Division of application No. 15/546,262, filed as application No. PCT/IB2016/050506 on Feb. 1, 2016, now Pat. No. 11,060,174.

(30) Foreign Application Priority Data

Jan. 30, 2015 (WO) ..... PCT/IB2015/050722

(51) Int. Cl.
*B21D 39/00* (2006.01)
*C23C 2/06* (2006.01)
(Continued)

(52) U.S. Cl.
CPC ..... *C23C 2/06* (2013.01); *C23C 2/26* (2013.01); *C23C 22/05* (2013.01); *C23F 11/14* (2013.01);
(Continued)

(58) Field of Classification Search
None
See application file for complete search history.

(56) References Cited

U.S. PATENT DOCUMENTS 3,625,744 A 12/1971 Juna
3,985,695 A 10/1976 Tobias
(Continued)

FOREIGN PATENT DOCUMENTS

EP 2458031 A1 5/2012
JP S49009020 B 3/1974
(Continued)

OTHER PUBLICATIONS

ISR of PCT/IB2016/050506 dated May 9, 2016.

*Primary Examiner* — Seth Dumbris
(74) *Attorney, Agent, or Firm* — Davidson, Davidson & Kappel, LLC

(57) ABSTRACT

A coated metal sheet is provided. The coated metal sheet includes a steel substrate, a metal coating on at least one face of the steel substrate, the metal coating comprising at least 40% by weight of zinc; and a layer coating an outer surface of the metal coating, the layer including an amino acid in a neutral or salt form, the amino acid being selected from among alanine, arginine, aspartic acid, cysteine, glutamine, lysine, methionine, proline, serine, threonine, or of a mixture thereof, the amount of said amino acid or of said mixture being from 0.1 to 200 mg/m$^2$, and optionally a base or a mixture of bases, or an acid or a mixture of acids.

18 Claims, 1 Drawing Sheet

(51) Int. Cl.

| | |
|---|---|
| ***C23C 2/26*** | (2006.01) |
| ***C23C 22/05*** | (2006.01) |
| ***C23F 11/14*** | (2006.01) |
| ***C25D 3/22*** | (2006.01) |
| ***C25D 5/48*** | (2006.01) |
| *C23C 22/78* | (2006.01) |

(52) U.S. Cl.
CPC ..... *C23F 11/144* (2013.01); *C25D 3/22* (2013.01); *C25D 5/48* (2013.01); *C23C 22/78* (2013.01); *Y10T 428/12556* (2015.01)

(56) References Cited

U.S. PATENT DOCUMENTS

| | | | | |
|---|---|---|---|---|
| 6,162,508 | A | 12/2000 | Trumble et al. | |
| 6,235,410 | B1 * | 5/2001 | Komatsu | C23C 2/06 428/659 |
| 6,432,220 | B1 | 8/2002 | Lindemann et al. | |
| 6,528,182 | B1 | 3/2003 | Bello et al. | |
| 7,335,248 | B2 * | 2/2008 | Abou-Nemeh | A01N 59/16 106/15.05 |
| 7,749,368 | B2 | 7/2010 | McMurdie et al. | |
| 2002/0081452 | A1 | 6/2002 | Nakajima | |
| 2004/0104122 | A1 | 6/2004 | Bibber | |
| 2005/0121114 | A1 | 6/2005 | Fernandez Gonzalez et al. | |
| 2006/0193988 | A1 | 8/2006 | Walter et al. | |
| 2008/0230395 | A1 | 9/2008 | Inbe et al. | |
| 2010/0261024 | A1 | 10/2010 | Sakashita et al. | |
| 2012/0145282 | A1 | 6/2012 | Kodama et al. | |
| 2014/0360630 | A1 * | 12/2014 | Arnold | C23C 22/83 148/247 |
| 2015/0140280 | A1 | 5/2015 | Inbe et al. | |
| 2015/0352825 | A1 | 12/2015 | Richard et al. | |
| 2016/0010216 | A1 | 1/2016 | Allely et al. | |

FOREIGN PATENT DOCUMENTS

| | | | |
|---|---|---|---|
| JP | S50115138 | A | 9/1975 |
| JP | H08296053 | | 11/1996 |
| JP | 2002086613 | A | 3/2002 |
| JP | 2002363799 | A | 12/2002 |
| JP | 2005529189 | A | 9/2005 |
| JP | 2005325404 | A | 11/2005 |
| JP | 2006519307 | A | 8/2006 |
| JP | 2007284710 | A | 11/2007 |
| JP | 2009068085 | A | 4/2009 |
| WO | 2008076684 | A1 | 6/2008 |
| WO | 2013160867 | A1 | 10/2013 |

* cited by examiner

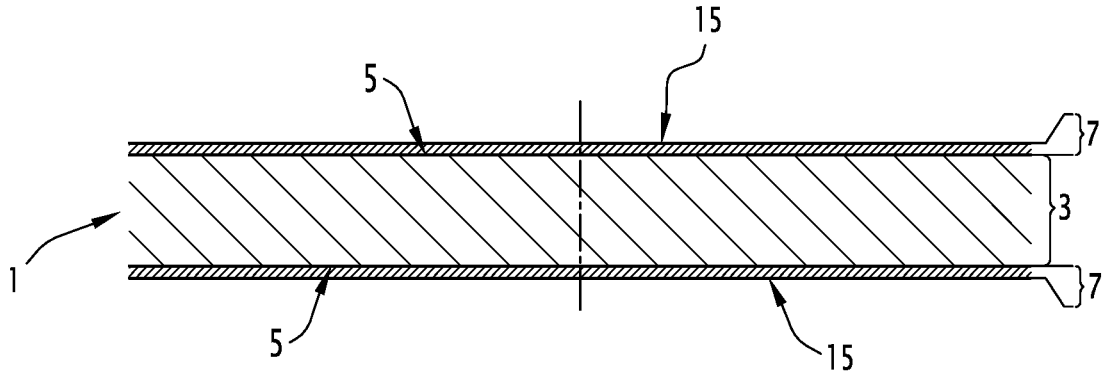
15
5
7
3
1
7
5
15

COATED METAL SHEET HAVING AN AMINO ACID TO IMPROVE CORROSION RESISTANCE

CROSS REFERENCE TO RELATED APPLICATIONS

This is a divisional of U.S. application Ser. No. 15/546,262 filed Jul. 25, 2017 which is a National Stage of PCT/IB2016/050506 filed Feb. 1, 2016 which claims priority to PCT/IB2015/050722 filed Jan. 30, 2015, the entire disclosures of which are hereby incorporated by reference herein.

FIELD OF THE INVENTION

The present invention is directed to a metal sheet comprising a steel substrate having two faces, at least one of which is coated with a metal coating comprising at least 40% by weight of zinc, to its preparation method and to the use of an amino acid for improving the resistance to corrosion of metal sheets coated with coatings based on zinc.

The invention is also directed to a coated steel metal sheet. Before being used, the coated steel metal sheets are generally subject to diverse surface treatments.

BACKGROUND

Application Publication US 2010/0261024 describes the application of an aqueous solution of glycine or glutamic acid in a neutral or salt form on a steel metal sheet coated with a coating based on zinc for improving resistance to corrosion of the metal sheet.

Application Publication WO 2008/076684 describes the application on a steel metal sheet coated with zinc, on an zinc-electroplated steel metal sheet or on a galvanized steel metal sheet of a composition of pretreatment consisting in an aqueous solution comprising a compound comprising a metal of the group IIIB (Sc, Y, La, Ac) or of the group IVB (Ti, Zr, Hf, Rf) and a compound based on copper, for example copper aspartate or glutamate, followed by the application of a composition comprising a film-forming resin and a compound based on yttrium. The addition of copper in a solution comprising a metal of the group IIIB or of the group IVB is described as improving resistance to corrosion of the metal sheet.

Application Publication EP 2 458 031 describes the application on a galvanized steel metal sheet GI, or galvanized alloy GA, of a solution for a conversion treatment comprising a compound (A) selected from among water-soluble titanium or zirconium compounds and an organic compound (B) which may notably be glycine, alanine, asparagine, glutamic or aspartic acid in a neutral or salt form. According to this application, the compound (A) forms on the metal sheet a conversion film which improves the compatibility of the metal sheet with the coatings applied subsequently, such as cataphoretic paints, and its resistance to corrosion. The compound (B) is described as stabilizing the compound (A).

These coated steel metal sheets are for example intended for the automotive field. The metal coatings essentially comprising zinc are traditionally used for their good protection against corrosion.

BRIEF SUMMARY OF THE INVENTION

An object of the invention is to provide a method for preparing a steel metal sheet coated with a metal coating comprising zinc which has a further increased resistance to corrosion.

For this purpose, the invention is directed to a method for preparing a metal sheet 1 comprising at least the steps of:

- providing a steel substrate 3, at least one face 5 of which is coated with a metal coating 7 comprising at least 40% by weight of zinc,
- applying on the outer surface 15 of the metal coating 7 an aqueous solution comprising an amino acid selected from among alanine, arginine, aspartic acid, cysteine, glutamine, lysine, methionine, proline, serine, threonine, and a mixture thereof, each amino acid being in a neutral or salt form,
- the aqueous solution being free of any compound comprising a metal from the group IIIB or from the group IVB, and
- the mass percentage as a dry extract of the amino acid in neutral or salt form or of the mixture of amino acids in the neutral or salt forms in the aqueous solution being greater than or equal to 50%.

The method may also comprise the following characteristics, taken individually or as a combination:

- the method comprises a preliminary step for preparing the steel substrate 3, at least one face 5 of which is coated with a metal coating 7, selected from among hot galvanization, a sonic vapor jet deposition and an electro-zinc-plating of the steel substrate 3;
- the metal coating 7 is selected from among a zinc coating GI, a zinc coating GA, a zinc and aluminum alloy, a zinc and magnesium alloy and a zinc, magnesium and aluminum alloy;
- the metal coating 7 is a zinc and magnesium alloy comprising between 0.1 and 10% by weight of Mg and optionally between 0.1 and 20% by weight of Al, the remainder of the metal coating being Zn, inevitable impurities and optionally one or several added elements selected from among Si, Sb, Pb, Ti, Ca, Mn, Sn, La, Ce, Cr, Ni or Bi;
- the amino acid is selected from among alanine, aspartic acid, cysteine, glutamine, methionine, proline, serine, threonine, and a mixture thereof, each amino acid being in a neutral or salt form;
- the amino acid is selected from among proline in the neutral or salt form, cysteine in the neutral or salt form, and a mixture thereof;
- the steel substrate 3, at least one face 5 of which is coated with a metal coating 7 was prepared by electro-zinc-plating and the amino acid is selected from among aspartic acid, cysteine, methionine, proline and threonine, and a mixture thereof, each amino acid being in the neutral or salt form;
- the steel substrate 3 at least one face 5 of which is coated with a metal coating 7 was prepared by hot galvanization and the amino acid is selected from among alanine, arginine, glutamine, lysine, methionine, proline, serine, threonine and a mixture thereof, each amino acid being in a neutral or salt form;
- the amino acid is proline in the neutral or salt form;
- the amino acid is threonine in the neutral or salt form;
- the amino acid is a mixture of proline and of threonine, the proline and the threonine being in the neutral or salt form;
- the aqueous solution comprises from 1 to 200 g/L of amino acid in the neutral or salt form or of a mixture of amino acids in the neutral or salt forms;
- the aqueous solution comprises from 10 to 1,750 mmol/L of amino acid in the neutral or salt form or of a mixture of amino acids in the neutral or salt forms;

the mass percentage in dry extract of the amino acid in the neutral or salt form or of the mixture of amino acids in the neutral or salt forms in the aqueous solution is greater than or equal to 75%;

the aqueous solution has a pH comprised between a pH equal to [isoelectric point of the amino acid−3] and a pH equal to the [isoelectric point of the amino acid+1], preferably comprised between a pH equal to the [isoelectric point of the amino acid−3] and a pH equal to the [isoelectric point of the amino acid−1];

the aqueous solution is applied at a temperature comprised between 20 and 70° C.

the solution is applied for a period comprised between 0.5 s and 40 s on the outer surface 15 of the metal coating 7;

the solution is applied by coating with a roller;

the method comprises, after the step for applying on the outer surface 15 of the metal coating 7 an aqueous solution comprising an amino acid, a drying step;

the drying is carried out by subjecting the metal sheet 1 to a temperature comprised between 70 and 120° C. for 1 to 30 seconds;

the method comprises, after the step for applying on the outer surface 15 of the metal coating 7 an aqueous solution comprising an amino acid and the optional drying step, a step for applying a grease or oil film on the outer surface 15 of the coating 7 coated with a layer comprising an amino acid or a mixture of amino acids;

the method comprises, after the step for applying on the outer surface 15 of the metal coating 7 an aqueous solution comprising an amino acid, the optional drying step and the optional step for applying a grease or oil film, a step for shaping the metal sheet 1;

the shaping of the metal sheet 1 is achieved by drawing.

The invention is also directed to a metal sheet which may be obtained by the method according to the invention, for which at least one portion of at least one outer surface 15 of the metal coating 7 can be coated with a layer comprising from 0.1 to 200 mg/m$^2$ of amino acid in the neutral or salt form or of a mixture of amino acids in the neutral or salt forms, and/or for which at least one portion of at least one outer surface 15 of the metal coating 7 can be coated with a layer comprising from 75 to 100% by weight of amino acid in the neutral or salt form, or of a mixture of amino acids in the neutral or salt forms and to the following uses:

the use of an aqueous solution comprising an amino acid selected from among alanine, arginine, aspartic acid, cysteine, glutamine, lysine, methionine, proline, serine, threonine, and a mixture thereof, each amino acid being in the neutral or salt form, the aqueous solution being free of any compound comprising a metal from the group IIIB or from the group IVB, and the mass percentage in dry extract of the amino acid in the neutral or salt form or of the mixture of amino acids in the neutral or salt forms in the aqueous solution being greater than or equal to 50%, for improving the resistance to corrosion of an outer surface 15 of a metal coating 7 coating at least one face 5 of a steel substrate 3, wherein the metal coating 7 comprises at least 40% by weight of zinc;

the use of an aqueous solution comprising an amino acid selected from among proline, threonine and a mixture thereof, the proline and the threonine being independently in a neutral or salt form, the aqueous solution being free of any compound comprising a metal from the group IIIB or from the group IVB, for:

improving the compatibility, with an adhesive 13, of at least one portion of an outer surface 15 of a metal coating 7 coating at least one face 5 of a steel substrate 3, improving the resistance to corrosion of the outer surface 15 of the metal coating 7 coating at least one face 5 of the steel substrate 3, and improving the tribological properties of the outer surface 15 of the metal coating 7 coating at least one face 5 of the steel substrate 3, wherein the metal coating 7 comprises at least 40% by weight of zinc.

BRIEF DESCRIPTION OF DRAWINGS

FIG. 1 is a schematic sectional view illustrating the structure of a metal sheet 1 obtained by a method according to the invention.

DETAILED DESCRIPTION OF THE INVENTION

The invention will now be illustrated by examples given as an indication, and non-limiting, and with reference to the appended FIG. 1.

The metal sheet 1 of the FIGURE comprises a steel substrate 3 covered on each of its two faces 5 with a metal coating 7. It will be observed that the relative thicknesses of the substrate 3 and of the coatings 7 covering it have not been observed on the FIGURE in order to facilitate the representation.

The coatings 7 present on both faces 5 are similar and only one will be described in detail subsequently. Alternatively (not shown), only one of the faces 5 has a metal coating 7.

The metal coating 7 comprises more than 40% by weight of zinc, notably more than 50% by weight of zinc, preferably more than 70% by weight of zinc, more preferentially more than 90%, preferably more than 95%, preferably more than 99%. The balance may consist of the metal elements Al, Mg, Si, Fe, Sb, Pb, Ti, Ca, Sr, Mn, Sn, La, Ce, Cr, Ni or Bi, taken alone or as a combination. The measurement of the composition of a coating is generally achieved by chemical dissolution of the coating. The given result corresponds to an average content in the whole of the layer.

The metal coating 7 may comprise several successive layers of different compositions, each of these layers comprising more than 40% by weight of zinc (or more, as defined above). The metal coating 7, or one of its constitutive layers, may also have a concentration gradient in one given metal element. When the metal coating 7, or one of its constitutive layers, has a zinc concentration gradient, the average proportion of zinc in the metal coating 7, or in this constitutive layer, is of more than 40% by weight of zinc (or more, as defined above).

For making the metal sheet 1, it is for example possible to proceed as follows.

The method may comprise a preliminary step for preparing the steel substrate 3 having two faces 5, at least one of which is coated with a metal coating 7 comprising at least 40% by weight of zinc. A steel substrate 3 is used, for example obtained by hot and then cold rolling. The metal coating 7 comprising more than 40% by weight of zinc may be deposited on the substrate 3 by any known deposition method, notably by electro-zinc-plating, physical vapor deposition (PVD), jet vapor deposition (JVD) or hot-dip galvanization.

According to a first alternative, the steel substrate 3 having two faces 5, at least one of which is coated with a metal coating 7 comprising at least 40% by weight of zinc is obtained by electro-zinc-plating of the steel substrate 3. The application of the coating may take place on one face (the metal sheet 1 then only comprises a metal coating 7), or on two faces (the metal sheet 1 then comprises two metal coatings 7).

According to a second alternative, the steel substrate 3 having two faces 5, at least one of which is coated with a metal coating 7 comprising at least 40% by weight of zinc is obtained by hot galvanization of the steel substrate 3.

Generally, the substrate 3 is then in the form of a strip which one runs through a bath for depositing the metal coating 7 by hot galvanization. The composition of the bath varies according to whether the desired metal sheet 1 is a galvanized steel sheet GI, a galvannealed steel sheet (GA) or a sheet coated with an alloy of zinc and of magnesium, an alloy of zinc and aluminum or an alloy of zinc, magnesium and aluminum. The bath may also contain up to 0.3% by weight of additional optional elements such as Si, Sb, Pb, Ti, Ca, Mn, Sn, La, Ce, Cr, Ni or Bi. These different additional elements may notably give the possibility of improving ductility or the adhesion of the metal coating 7 on the substrate 3. One skilled in the art, who knows their effects on the characteristics of the metal coating 7, will know how to use them according to the sought complementary purpose. The bath may finally contain residual elements stemming from the supply ingots, or resulting from the passage of the substrate 3 in the bath, a source of inevitable impurities in the metal coating 7.

In an embodiment, the steel substrate 3 having two faces 5, at least one of which is coated with a metal coating 7 comprising at least 40% by weight of zinc, is a galvanized steel sheet GI. The metal coating 7 is then a zinc coating GI. Such a coating comprises more than 99% by weight of zinc.

In another embodiment, the steel substrate 3 having two faces 5, at least one of which is coated with a metal coating 7 comprising at least 40% by weight of zinc is a galvanized steel sheet GA. The metal coating 7 is then a zinc coating GA. A galvanized steel sheet GA is obtained by annealing of a galvanized steel sheet GI. In this case, the method therefore comprises a hot galvanization step of the steel substrate 3, and then an annealing step. The annealing causes diffusion of the iron of the steel substrate 3 into the metal coating 7. The metal coating 7 of a GA sheet typically comprises from 10% to 15% by weight of iron.

In another embodiment, the metal coating 7 is an alloy of zinc and of aluminum. The metal coating 7 may for example comprise 55% by weight of aluminum, 43.5% by weight of zinc and 1.5% by weight of silicone, like Aluzinc® sold by ArcelorMittal.

In another embodiment, the metal coating 7 is an alloy of zinc and magnesium, preferably comprising more than 70% by weight of zinc. The metal coatings comprising zinc and magnesium will be globally designated here under the term of zinc-magnesium coatings or ZnMg coatings. The addition of magnesium to the metal coating 7 clearly increases the resistance to corrosion of these coatings, which may give the possibility of reducing their thickness or of increasing the protection guarantee against corrosion over time.

The metal coating 7 may notably be an alloy of zinc, magnesium and aluminum, preferably comprising more than 70% by weight of zinc. The metal coatings comprising zinc, magnesium and aluminum will be globally designated here under the term of zinc-, aluminum-, magnesium or ZnAlMg coatings. The addition of aluminum (typically of the order of 0.1% by weight) to a coating based on zinc and on magnesium also gives the possibility of improving the resistance to corrosion, and makes the coated sheet easier to be shaped. Thus, the metal coatings essentially comprising zinc are presently in competition with coatings comprising zinc, magnesium and optionally aluminum.

Typically, the metal coating 7 of the ZnMg or ZnAlMg type comprised between 0.1 and 10% by weight, typically between 0.3 and 10% by weight, notably between 0.3 and 4% by weight of magnesium. Below 0.1% by weight of Mg, the coated sheet resists less to corrosion and beyond 10% by weight of Mg, the ZnMg or ZnAlMg coating subject to too much oxidation and cannot be used.

In the sense of the present application, when a range of numbers is described as being between a low limit and an upper limit, it is understood that these limits are included. For example, a coating comprising 0.1% or 10% by weight of magnesium is included when the expression "The metal coating 7 comprises between 0.1 and 10% by weight of magnesium" is used.

The metal coating 7 of the ZnAlMg type comprises aluminum, typically between 0.5 and 11% by weight, notably between 0.7 and 6% by weight, preferably between 1 and 6% by weight of aluminum. Typically, the mass ratio between magnesium and aluminum in the metal coating 7 of the ZnAlMg type is strictly less than or equal to 1, preferably strictly less than 1, and further preferably strictly less than 0.9.

The most common inevitable impurity present in the metal coating 7 and resulting from the passage of the substrate in the bath is iron which may be present at a content ranging up to 3% by weight, generally less than or equal to 0.4% by weight, typically comprised between 0.1 and 0.4% by weight relatively to the metal coating 7.

The inevitable impurities stemming from the supply ingots, for the ZnAlMg baths, are generally lead (Pb), present at a content of less than 0.01% by weight relatively to the metal coating 7, Cadmium (Cd), present at a content of less than 0.005% by weight relatively to the metal coating 7 and tin (Sn), present at a content of less than 0.001% by weight relatively to the metal coating 7.

Additional elements selected from among Si, Sb, Pb, Ti, Ca, Mn, Sn, La, Ce, Cr, Ni or Bi may be present in the metal coating 7. The weight content of each additional element is generally less than 0.3%.

The metal coating 7 generally has a thickness of less than or equal to 25 μm and conventionally aims at protecting the steel substrate 3 against corrosion.

After depositing the metal coating 7, the substrate 3 is for example drained by means of nozzles projecting gas on either side of the substrate 3.

The metal coating 7 is then left to cool in a controlled way so that it solidifies. The controlled cooling of the metal coating 7 is ensured at a rate preferably greater than or equal to 15° C./s or further greater than 20° C./s between the beginning of the solidification (i.e. when the metal coating 7 falls just below the temperature of the liquidus) and the end of the solidification (i.e. when the metal coating 7 attains the temperature of the solidus).

Alternatively, the draining may be adapted so as to remove the metal coating 7 deposited on one face 5 so that only one of the faces 5 of the metal sheet 1 are definitively coated with a metal coating 7.

The thereby treated strip may then be subject to a so called skin-pass step which gives the possibility of work hardening it and of giving it a roughness facilitating its subsequent shaping.

The outer surface 15 of the metal coating 7 is subject to a surface treatment step which consists of applying to them an aqueous solution comprising an amino acid selected from among alanine, arginine, aspartic acid, cysteine, glutamine, lysine, methionine, proline, serine, threonine, and a mixture of the latter. Each amino acid may be in a neutral or salt form. In the sense of the application, an amino acid is one of the 22 protein-generating amino acids (isomer L) or one of their isomers, notably their D isomers. The amino acid is preferably an L amino acid for reasons of cost.

The invention lies on the unexpected discovery that the application on the outer surface 15 of the metal coating 7 of an aqueous solution comprising an amino acid from the list mentioned above gives the possibility of improving the resistance to corrosion of the obtained sheet. This improvement is not observed regardless of the amino acid used. For example, the resistance to corrosion was not improved by applying valine on a sheet coated with a metal coating 7 comprising at least 40% by weight of zinc. For the moment, no theory has been put forward for explaining why certain amino acids give the possibility of improving the resistance to corrosion and not other ones.

The applied aqueous solution may comprise an amino acid selected from among alanine, arginine, aspartic acid, cysteine, glutamine, lysine, methionine, proline, serine, threonine, and a mixture thereof, each amino acid being in the neutral or salt form.

The applied aqueous solution may comprise an amino acid selected from among alanine, arginine, aspartic acid, glutamine, lysine, methionine, proline, serine, threonine, and a mixture thereof, each amino acid being in a neutral or salt form. The applied aqueous solution may notably comprise an amino acid selected from among alanine, aspartic acid, cysteine, glutamine, methionine, proline, serine, threonine and a mixture thereof, each amino acid being in a neutral or salt form.

The applied aqueous solution may for example comprise an amino acid selected from among alanine, aspartic acid, glutamine, methionine, proline, serine, threonine, and a mixture thereof, each amino acid being in a neutral or salt form.

Preferably, in the first alternative in which the metal sheet 1 is an electro-zinc-plated steel sheet, the amino acid of the applied aqueous solution is selected from among aspartic acid, cysteine, methionine, proline and threonine, and a mixture thereof, each amino acid being in a neutral or salt form, in particular from among aspartic acid, methionine, proline and threonine, and a mixture thereof, each amino acid being in a neutral or salt form.

Preferably, in the second alternative wherein the metal sheet 1 is a sheet obtained by hot galvanization of the steel substrate 3, the amino acid of the applied aqueous solution is selected from among alanine, arginine, glutamine, lysine, methionine, proline, serine, threonine and a mixture thereof, each amino acid being in a neutral or salt form. For example, the amino acid of the applied aqueous solution is selected from among alanine, glutamine, methionine, proline, serine, threonine or a mixture thereof, each amino acid being in a neutral or salt form.

Preferably, in the third alternative wherein the metal sheet 1 is equally an electro-zinc-plated steel sheet or a sheet obtained by hot galvanization of the steel substrate 3, the amino acid of the applied aqueous solution is selected from among methionine, proline and threonine and a mixture thereof, each amino acid being in a neutral or salt form.

The amino acid is notably selected from among proline in a neutral or salt form, cysteine in a neutral or salt form, or a mixture thereof. Proline is particularly efficient for improving resistance to corrosion. Cysteine advantageously gives the possibility of dosing the amount of amino acid deposited at the surface by its thiol function, for example by X fluorescence spectrometry (XFS).

Preferably, the amino acid is selected from among proline in a neutral or salt form, threonine in a neutral or salt form, or a mixture of the latter. The proline and threonine actually give the possibility not only of improving resistance to corrosion of the metal sheet, but also improving the compatibility of the surface with an adhesive and improving the tribological properties of the surface of the sheet (which makes it well adapted to its subsequent shaping, notably by drawing).

The improvement in the compatibility of the surface of the metal sheet with an adhesive may for example be demonstrated by carrying out tensile tests on samples of metal sheets assembled via an adhesive and optionally aged, until rupture of the assembly and by measuring the maximum tensile stress and the nature of the rupture. The improvement in the tribological properties may for example be shown by measuring the friction coefficient ($\mu$) versus the contact pressure (MPa), for example from 0 to 80 MPa.

It is particularly surprising that threonine and/or proline give the possibility of improving these three properties at a time. Under the tested conditions, the other amino acids did not give the possibility of an improvement of these three properties on any type of metal coating comprising at least 40% by weight of zinc (at best, the other amino acids gave the possibility of observing an improvement of two of these properties, but not of the three).

The applied aqueous solution generally comprises from 1 to 200 g/L, notably from 5 g/L to 150 g/L, typically from 5 g/L to 100 g/L, for example from 10 to 50 g/L of amino acid in a neutral or salt form or of a mixture of amino acids in neutral or salt forms. The most significant improvement in the resistance to corrosion of the metal coating 7 of the metal sheet 1 was observed by using an aqueous solution comprising from 5 g/L to 100 g/L, in particular from 10 to 50 g/L of an amino acid or of a mixture of amino acid.

The applied aqueous solution generally comprises from 10 to 1,750 mmol/L, notably from 40 mmol/L to 1,300 mmol/L, typically from 40 mmol/L to 870 mmol/L, for example from 90 to 430 mmol/L of amino acid in a neutral or salt form or of a mixture of amino acids in neutral or salt forms. The most significant improvement of the resistance to corrosion of the metal coating 7 of the metal sheet 1 was observed by using an aqueous solution comprising from 40 mmol/L to 870 mmol/L, in particular from 90 to 430 mmol/L of amino acid or of amino acid mixture.

Of course, the mass and molar proportions of the amino acid (or of each of the amino acids when a mixture of amino acids is used) in the aqueous solution cannot be greater than the proportions corresponding to the solubility limit of the amino acid at the temperature at which the aqueous solution is applied.

Generally, the mass percentage of dry extract of the amino acid in a neutral or salt form or of the mixture of amino acids in neutral or salt forms in the aqueous solution is greater than or equal to 50%, notably greater than or equal to 65%, typically greater than or equal to 75%, notably greater than or equal to 90%, preferably greater than or equal to 95%. Also, generally, the molar percentage of dry extract of the amino acid in a neutral or salt form in the aqueous solution is greater than or equal to 50%, typically greater than or equal to 75%, notably greater than or equal to 90%, preferably greater than or equal to 95%.

The aqueous solution may comprise zinc sulfate and/or iron sulfate. The zinc sulfate proportion in the aqueous solution is generally less than 80 g/L, preferably less than 40 g/L. Preferably, the aqueous solution is free of zinc sulfate and of iron sulfate.

Generally, the aqueous solution comprising an amino acid comprises less than 10 g/L, typically less than 1 g/L, generally less than 0.1 g/L, notably less than 0.05 g/L, for example less than 0.01 g/L of zinc ions. Preferably, the aqueous solution is free of zinc ion (in addition to inevitable traces, which may for example stem from pollution, by the substrate, of the aqueous solution bath).

The aqueous solution comprising an amino acid generally comprises less than 0.005 g/L of iron ions. The aqueous solution comprising an amino acid generally comprises very few metal ions other than potassium, sodium, calcium and zinc, typically less than 0.1 g/L, notably less than 0.05 g/L, for example less than 0.01 g/L, preferably less than 0.005 g/L of metal ions other than potassium, sodium, calcium and zinc. Typically, the aqueous solution is free of metal ions other than zinc, calcium, sodium and potassium. The aqueous solution comprising an amino acid generally comprises few metal ions other than zinc, typically less than 0.1 g/L, notably less than 0.05 g/L, for example less than 0.01 g/L, preferably less than 0.005 g/L of metal ions other than zinc. Typically, the aqueous solution is free of metal ions other than zinc. In particular, the aqueous solution comprising an amino acid generally comprises few cobalt and/or nickel ions, typically less than 0.1 g/L, notably less than 0.05 g/L, for example less than 0.01 g/L of cobalt and/or nickel ions. Preferably, the aqueous solution is free of cobalt ions and/or free of nickel ions and/or free of copper ions and/or free of chromium ions. The aqueous solution is free of a compound comprising a metal of the group IIIB (Sc, Y, La, Ac) or of the group IVB (Ti, Zr, Hf, Rf). Preferably, it is free of metal ions (in addition to inevitable metal impurities, which may for example stem from the pollution, by the substrate, of the aqueous solution bath).

Generally, the absence of metal ions in the aqueous solution may avoid perturbation of the action of the active ingredient which is the amino acid or the mixture of amino acids.

Further, the aqueous solution comprising an amino acid generally comprises less than 0.1 g/L, notably less than 0.05 g/L, for example less than 0.01 g/L of compounds comprising chromium VI, or more generally chromium. Generally, it is free of compounds comprising chromium VI, or more generally chromium.

Moreover, the aqueous solution is generally free of an oxidizing agent.

Moreover, the aqueous solution is generally free of resin, in particular of organic resin. A resin designates a polymeric product (natural, artificial or synthetic) which is a raw material for, for example making plastic materials, textiles, paints (liquids or in the form of powder), adhesives, varnishes, polymeric foams. It may be thermoplastic or thermosetting. More generally, the aqueous solution is generally free of polymer.

The absence of resin gives the possibility of obtaining a treatment layer of a small thickness and of thereby facilitating its removal during degreasing preceding phosphating and painting. A resin has, under these conditions, a tendency to let through residues which perturb the phosphating.

The pH of the applied aqueous solution is generally comprised of a pH equal to [isoelectric point of the amino acid−3] at a pH equal to the [isoelectric point of the amino acid+3], notably a pH equal to the [isoelectric point of the amino acid−2] at a pH equal to the [isoelectric point of the amino acid+2], preferably with a pH equal to [isoelectric point of the amino acid−1] at a pH equal to the [isoelectric point of the amino acid+1]. For example, when the amino acid is proline for which the isoelectric point is 6.3, the pH of the aqueous solution is generally from 3.3 to 9.3, notably from 4.3 to 8.3, preferably from 5.3 to 7.3.

The pH of the applied aqueous solution is generally comprised of a pH equal to the [isoelectric point of the amino acid−3] at a pH equal to the [isoelectric point of the amino acid+1], preferably with a pH equal to the [isoelectric point of the amino acid−3] at a pH equal to the [isoelectric point of the amino acid−1], notably with a pH equal to the [isoelectric point of the amino acid−2.5] at a pH equal to the [isoelectric point of the amino acid−1.5], typically a pH equal to the [isoelectric point of the amino acid−2]. For example, when the amino acid is proline for which the isoelectric point is 6.3, the pH of the aqueous solution is preferably from 3.3 to 5.3, notably from 3.8 to 4.8, typically of the order of 4.0, like 4.3. Such a pH actually gives the possibility of promoting the bond between the amino acid and the metal coating 7. In particular, a method applied with a solution having such a pH gives the possibility of obtaining a metal sheet which retains its improved properties of resistance to corrosion, even when it has been subject to a washing/re-oiling treatment. Generally, once the metal sheet according to the invention has been prepared, it may be cut out in flanks before it shaping, typically by drawing. In order to remove the impurities deposited on the metal sheet stemming from this cutting out, a washing/re-oiling treatment may be applied. The latter consists of applying on the surfaces of the metal sheet an oil of low viscosity, and then of brushing, and then applying an oil with greater viscosity. Without intending to be bound by a particular theory, it is assumed that a solution having such a pH gives the possibility of obtaining the amino acid in a protonated form ($NH_3^+$), which would promote the bond between the amino acid and the metal coating 7 and therefore the maintaining of the amino acid at the surface in spite of the washing/re-oiling treatment. At different pHes and notably greater than [isoelectric point of the amino acid−1], the amine of the amino acid is not very or not protonated: the bonds between the amino acid and the metal coating 7 will be less strong and the amino acid will tend to more be dissolved in the oil used during the washing/re-oiling treatment, leading to its at least partial removal, and therefore to less good properties of resistance to corrosion.

One skilled in the art knows how to adapt the pH of the aqueous solution, by adding a base if the intention is to increase the pH, or an acid, such as phosphoric acid, if the intention is to decrease it. In the sense of the application, a base or an acid is equally in a neutral and/or salt form. Generally, the acid proportion is less than 10 g/L, notably 1 g/L in the solution. Preferably, phosphoric acid is added together in its neutral form and in its salt form (for example of sodium, calcium or even potassium) for example in a $H_3PO_4/NaH_2PO_4$ mixture. The phosphoric acid advantageously gives the possibility of dosing the amount of aqueous solution (and therefore of amino acid) deposited at the surface by means of the phosphorus and/or sodium atoms, for example by X fluorescence spectrometry (XFS).

In an embodiment, the aqueous solution consists in a mixture of water, of amino acid in a neutral or salt form or as a mixture of amino acids independently in neutral or salt forms and optionally of a base or a mixture of bases, or an acid or a mixture of acids. The base or the acid is used for adapting the pH of the aqueous solution. The amino acid gives the properties for improving resistance to corrosion. The base or the acid give the possibility of reinforcing this effect. The addition of other compounds is not required.

In the method according to the invention, the aqueous solution comprising an amino acid may be applied at a temperature comprised between 20 and 70° C. The application time of the aqueous solution may be between 0.5 s and 40 s, preferably between 2 s and 20 s.

The aqueous solution comprising an amino acid may be applied by immersion, spraying or any other system.

The application of the aqueous solution on the outer surface 15 of the metal coating 7 may be carried out by any means, for example by immersion, by spraying or by coating with a roller ("roll coating"). This last technique is preferred since it gives the possibility of more easily controlling the amount of applied aqueous solution while ensuring a homogeneous distribution of the aqueous solution on the surface. Generally, the thickness of humid film consisting of the applied aqueous solution on the outer surface 15 of the metal coating 7 is from 0.2 to 5 μm, typically between 1 and 3 μm.

By "application on the outer surface 15 of the metal coating 7 of an aqueous solution comprising an amino acid", it is meant that the aqueous solution comprising an amino acid is put into contact with the outer surface 15 of the metal coating 7. It is therefore understood that the outer surface 15 of the metal coating 7 is not covered with an intermediate layer (a film, a coating or a solution) which would prevent the contacting of the aqueous solution comprising an amino acid with the outer surface 15 of the metal coating 7.

Typically, the method comprises, after the step for application on the outer surface 15 of the metal coating 7 of an aqueous solution comprising an amino acid, a drying step, which gives the possibility of obtaining on the outer surface 15 of the metal coating 7, a layer comprising (or consisting of) an amino acid (in the neutral or salt form) or a mixture of amino acids (independently in neutral forms or salt forms). The latter may be carried out by subjecting the metal sheet 1 to a temperature comprised between 70 and 120° C., for example between 80 and 100° C., generally for 1 to 30 seconds, notably 1 to 10 seconds, for example 2 s. In particular, a method applied with such a drying step gives the possibility of obtaining a metal sheet which retains its improved properties of resistance to corrosion, even when it has been subjected to a washing/re-oiling treatment.

The metal coating 7 of the metal sheet 1 obtained is then typically coated with a layer comprising from 0.1 to 200 $mg/m^2$, notably from 25 to 150 $mg/m^2$, in particular from 50 to 100 $mg/m^2$, for example from 60 to 70 $mg/m^2$ of amino acid (in neutral or salt form) or of a mixture of amino acids (independently in neutral and salt forms). The amount of amino acid deposited on the outer surface 15 of the metal coating 7 may be determined by dosing the amount of amino acid deposited (for example by infrared), or else by dosing the amount of amino acid remaining in the aqueous solution (for example by acid-base dosage and/or by conductimetry), given that the initial concentration of amino acid of the aqueous solution is known. Further, when the amino acid or one of the amino acids is cysteine, the amount of cysteine deposited at the surface may be determined by X fluorescence spectrometry (XFS).

Generally, the layer comprising an amino acid (in neutral or salt form) or a mixture of amino acids (independently in neutral or salt forms) which coat the metal coating 7 of the metal sheet 1 obtained comprises from 50 to 100% by weight, notably from 75 to 100% by weight, typically from 90 to 100% by weight of amino acid (in the neutral or salt form) or of a mixture of amino acids (independently in neutral or salt forms).

The method may comprise (or be free of) surface treatment steps other than the one consisting of applying an aqueous solution comprising an amino acid (for example a surface treatment by alkaline oxidation and/or a chemical conversion treatment). When this (these) surface treatment steps lead to the formation of a layer on the metal coating 7, this (these) other surface treatment steps is(are) carried out simultaneously or after the step for applying an aqueous solution comprising one amino acid on the outer surface 15 of the metal coating 7, so that there is no intermediate layer between the outer surface 15 of the metal coating 7 and the aqueous solution comprising an amino acid. These optional aforementioned surface treatment steps may comprise other sub-steps for rinsing, drying . . . .

After having applied the aqueous solution comprising an amino acid, a film of grease or oil is generally applied on the outer surface 15 of the metal coating 7 coated with a layer comprising an amino acid or a mixture of amino acids in order to protect it against corrosion.

The strip may optionally be wound up before being stored. Typically, before shaping the part, the strip is cut out. A grease or oil film may then be again applied on the outer surface 15 of the metal coating 7 coated with a layer comprising an amino acid or a mixture of amino acids before the shaping.

Preferably, the method is without any degreasing step (typically achieved by applying a basic aqueous solution with a pH generally greater than 9 on the outer surface 15 of the metal coating 7) before shaping. Indeed, the treatment with a basic aqueous solution on the outer surface 15 of the metal coating 7 coated with a layer comprising an amino acid or a mixture of amino acids may lead to partial or total removal of the amino acid(s) which have been deposited on the outer surface 15 of the metal coating 7, which one seeks to avoid.

The metal sheet may then be shaped by any method adapted to the structure and to the shape of the parts to be made, preferably by drawing, such as for example cold drawing. The shaped metal sheet 1 then corresponds to a part, for example an automotive part.

Once the metal sheet 1 has been shaped, the method may then comprise (or be without):

- a degreasing step, typically achieved by applying a basic aqueous solution on the outer surface 15 of the metal coating 7, and/or
- of any other surface treatment steps, for example a phosphating step, and/or
- a cataphoresis step.

The invention also relates to the metal sheet 1 which may be obtained by the method. Such a metal sheet comprises at least one portion of at least one outer surface 15 of the metal coating 7 coated with a layer comprising from 0.1 to 200 $mg/m^2$, notably from 25 to 150 $mg/m^2$, in particular from 50 to 100 $mg/m^2$, for example from 60 to 70 $mg/m^2$ of amino acid in a neutral or salt form.

The invention also relates to the use of an aqueous solution comprising an amino acid selected from among alanine, arginine, aspartic acid, cysteine, glutamine, lysine, methionine, proline, serine, threonine, and a mixture thereof, each amino acid being in a neutral or salt form, the aqueous solution being free of any compound comprising a metal of the group IIIB or of the group IVB, for improving the resistance to corrosion on an outer surface 15 of a metal coating 7 coating at least one face 5 of a steel substrate 3, wherein the metal coating 7 comprises at least 40% by weight of zinc.

The preferential embodiments described above for the aqueous solution, the conditions for applying the aqueous solution and the metal coating 7 are of course applicable.

The invention also relates to a method for improving the resistance to corrosion of an outer surface 15 of a metal coating 7 coating at least one face 5 of a steel substrate 3, comprising at least the steps of:

providing a steel substrate 3 having two faces 5, at least one of which is coated with a metal coating 7 comprising at least 40% by weight of zinc, application on the outer surface 15 of the metal coating 7 of an aqueous solution comprising an amino acid selected from among alanine, arginine, aspartic acid, cysteine, glutamine, lysine, methionine, proline, serine, threonine and a mixture thereof, each amino acid being in a neutral or salt form, the aqueous solution being free of any compound comprising a metal from the group IIIB or from the group IVB.

The preferential embodiments described above for the aqueous solution, the conditions for applying the aqueous solution, the metal coating 7 and the optional additional steps in the method are of course applicable.

The invention also relates to the use of an aqueous solution comprising an amino acid selected from among proline, threonine and a mixture thereof, proline and threonine being independently in a neutral or salt form, the aqueous solution being free of any compound comprising a metal from the group IIIB or from the group IVB, for:

improving the compatibility, with an adhesive 13, of at least one portion of an outer surface 15 of a metal coating 7 coating at least one face 5 of a steel substrate 3, improving the resistance to corrosion of the outer surface 15 of the metal coating 7 coating at least one face 5 of the steel substrate 3, and improving the tribological properties of the outer surface 15 of the metal coating 7 coating at least one face 5 of the steel substrate 3, wherein the metal coating 7 comprises at least 40% by weight of zinc.

The preferential embodiments described above for the aqueous solution, the conditions for applying the aqueous solution and the metal coating 7 are of course applicable.

The invention also relates to a method for:

improving the compatibility, with an adhesive 13, of at least one portion of an outer surface 15 of a metal coating 7 coating at least one face 5 of a steel substrate 3, improving the resistance to corrosion of the outer surface 15 of the metal coating 7 coating at least one face 5 of the steel substrate 3, and improving the tribological properties of the outer surface 15 of the metal coating 7 coating at least one face 5 of the steel substrate 3, said method comprising at least the steps of:

providing a steel substrate 3 having two faces 5, at least one of which is coated with a metal coating 7 comprising at least 40% by weight of zinc, applying on the outer surface 15 of the metal coating 7 an aqueous solution comprising an amino acid selected from among proline, threonine and a mixture thereof, the proline and the threonine being independently in a neutral or salt form, the aqueous solution being free of any compound comprising a metal from the group IIIB or from the group IVB.

The preferential embodiments described above for the aqueous solution, the conditions for applying the aqueous solution, the metal coating 7 and the optional additional steps in the method are of course applicable.

Example 1: Corrosion Resistance Tests

In order to illustrate the invention, the corrosion resistance tests were achieved according to the ISO 6270-2 standards of 2005 and/or VDA 230-213 standards of 2008 on steel sheet 1 covered with a metal coating 7 comprising about 99% of zinc (steel sheet GI), or else samples of electro-zinc-plated steel sheets 1 comprising 100% of zinc (steel sheet EG), on which was applied:

an aqueous solution of amino acid as defined above for which the pH had been optionally adjusted by adding $H_3PO_4$, and then Fuchs® 3802-39S oil in an amount of 3 g/m$^2$, and having then been drawn.

It appears that the metal sheets 1 obtained by a method according to the invention have better resistance to corrosion. The other properties of the metal sheets 1 obtained by the method according to the invention (mechanical properties, compatibility with subsequent cataphoresis and/or phosphating and/or painting steps) were not degraded.

Example 2: Friction Coefficient Measurement Tests (p) Versus the Contact Pressure (MPa) and Tensile Tests for the Amino Acids Proline and Threonine 2.1. Tensile Tests Tensile tests were achieved and are described as non-limiting examples.

Samples of steel sheets 1 covered with a metal coating 7 comprising about 99% of zinc (steel sheet GI), or else samples of steel sheets 1 which are electro-zinc-plated comprising 100% of zinc (steel sheet EG) were used.

Each specimen 27 was prepared in the following way. Tabs 29 were cut out in the metal sheet 1 to be evaluated. These tabs 29 have dimensions of 25 mm×12.5 mm×0.2 mm.

The tabs 29 were immersed for an immersion period of 20 s at a temperature of 50° C. in an aqueous solution of proline or threonine for which the pH was adjusted by adding $H_3PO_4$, except for the reference sheets (Ref) not having been subject to any treatment with an amino acid.

Fuchs® 3802-39S oil was applied on the tabs 29 in an amount of 3 g/m$^2$.

Two tabs 29 were adhesively bonded with an adhesive joint 31 BM1496V, BM1440G or BM1044, which are so called "crash" adhesives based on epoxy and marketed by Dow® Automotive. These adhesives were selected since these are adhesives conventionally leading to adhesive ruptures before ageing and/or after ageing of the adhesive.

The thereby formed specimen 27 was then brought to 180° C. and maintained at this temperature for 30 minutes, which allows baking of the adhesive.

Ageing tests were carried out with the specimens 27 for which the tabs 29 were adhesively bonded with the adhesive BM1044. The natural ageing of the adhesive is simulated by ageing with a humid poultice at 70° C. for 7 or 14 days.

The tensile test was then carried out at a room temperature of 23° C. by imposing a traction speed of 10 mm/min to a tab 29, in parallel with the latter, while the other tab 29 of the specimen 27 was attached. The test was continued until rupture of the specimen 27.

At the end of the test, the maximum tensile stress was noted and the nature of the rupture (cohesive rupture, when the rupture takes place in the thickness of the adhesive—adhesive rupture, when the rupture takes pace at one of the interfaces between the metal sheet and the adhesive—surface cohesive rupture, when the rupture takes place in the adhesive in the vicinity of an interface between the tabs and the metal sheet) (one being aware that in the automotive industry, one tries to avoid adhesive ruptures which express poor compatibility of the adhesive with the metal sheet).

In table 1 are grouped the results on metal sheet GI.

In table 2 are grouped the results on electro-zinc-plated sheet (EG).

SCR means surface cohesive rupture.

As illustrated by tables 1 and 2 below, the metal sheets 1 which have undergone a treatment with an aqueous solution comprising proline or threonine promote the occurrence of surface cohesive ruptures, unlike with the reference sheets for which more adhesive ruptures were ascertained.

In particular, on the sheets GI (table 1):

With the adhesive BM1496V, the fracture faces observed on the tests with proline or threonine exclusively consist of surface cohesive rupture, unlike the reference which has not undergone any treatment (Ref 1) where 30% of adhesive rupture was ascertained.

With the adhesive BM1440G, the fracture face observed on the tests with proline or threonine also exclusively consist of surface cohesive rupture, unlike the reference which has not undergone any treatment (Ref 2) where 20% of adhesive rupture was ascertained, With the adhesive BM1044, it is observed that the adherence of the adhesive son the metal sheets with proline or threonine (tests 7A to 7C) better age than on the reference, after 7 and 14 days of a humid poultice.

In particular, on the electro-zinc-plated metal sheets (table 2), with the adhesive BM1496V, the fracture faces observed on the tests 8A to 9B with proline or threonine in majority consist of surface cohesive rupture, unlike the reference which has not been subject to any treatment (Ref 6) where 40% of adhesive rupture was ascertained.

TABLE 1

Maximum tensile stresses and natures of the rupture for specimens based on tested GI metal sheets.

| No. of the test | Adhesive | Amino-acid | Concen-tration g/L | pH | Ageing (days) | Max stress MPa | Fracture face (SCR) |
|---|---|---|---|---|---|---|---|
| 2A | BM1496V | L- | 20 | 4 | NA | 17.8 | 100% |
| 2B | | Proline | 50 | | NA | 16.8 | 100% |
| 2C | | | 100 | | | 15.1 | 100% |
| 2D | | | 150 | | | 14.4 | 100% |
| 4A | | L- | 20 | 4 | | 16.8 | 100% |
| 4B | | Threonine | 50 | | | 15.9 | 100% |
| 4C | | | 80 | | | 15 | 100% |
| 4D | | | 100 | | | 14.8 | 100% |
| Ref 1 | | NA | NA | NA | NA | 17.9 | 70% |
| 6 | BM1440G | L- | 50 | nat- | NA | 14.5 | 100% |
| | | Proline | | ural | | | |
| Ref 2 | | NA | NA | NA | NA | 14.9 | 80% |
| 7A | BM1044 | L- | 50 | Nat- | NA | 10.6 | 100% |
| 7B | | Proline | | ural | 7 | 11.5 | 100% |
| 7C | | | | | 14 | 11.3 | 90% |
| Ref 3 | | NA | NA | NA | NA | 11.8 | 100% |
| Ref 4 | | | | | 7 | 12 | 80% |
| Ref 5 | | | | | 14 | 11.5 | 60% |

TABLE 2

Maximum tensile stresses and natures of the rupture for specimens based on tested electro-zinc-plated metal sheets.

| Test No. | Adhesive | Amino-acid | Concen-tration (g/L) | pH | Ageing (days) | Max stress (Mpa) | Fracture face (SCR) |
|---|---|---|---|---|---|---|---|
| 9A | BM1496V | L- | 20 | nat- | NA | 12.2 | 95% |
| 9B | | Proline | 50 | ural | | 10 | 100% |
| Ref 6 | | NA | NA | NA | NA | 14.6 | 60% |

2.2. Friction coefficient (μ) measurement tests according to the contact pressure (MPa)

Tests for measuring the friction coefficient (μ) versus the contact pressure (MPa) were achieved and are described as non-limiting examples.

Steel sheet samples 1 in covered with a metal coating 7 comprising about 99% of zinc (steel sheet GI of grade DX56D, thickness 0.7 mm), electro-zinc-plated steel sheet samples 1 for which the coating comprised 100% of zinc (steel sheet EG grade DC06, thickness 0.8 mm), steel sheet samples 1 Fortiform® electro-zinc-plated for which the coating comprised 100% of zinc (7.5 μm on both faces) or else samples of steel sheets 1 coated by depositing via a sonic vapor jet (Zn JVD) for which the coating comprised 100% of zinc (7.5 μm on both faces) were used.

In these steel sheets samples were cut out having dimensions of 450 mm×35 mm×thickness (0.7 mm for GI and 0.8 mm for EG). The samples were immersed for an immersion period of 20 s at a temperature of 50° C. in an aqueous solution of proline or threonine for which the pH had been optionally adjusted by adding $H_3PO_4$. Fuchs® 3802-39S oil (in an amount of 3 g/m$^2$), Fuchs® 4107S (rejected) or QUAKER 6130 (rejected) were applied on one face of the samples.

The friction coefficient (μ) was then measured versus the contact pressure (MPa) by varying the contact pressure from 0 to 80 MPa:

on the sample of the metal sheet treated with the thereby prepared aqueous solution of proline or of threonine, and on a coated metal sheet sample not treated with an amino acid (control).

Several tests phases were carried out (phases A, B, and C in the table 3 below).

As illustrated by the table 3 below, it is observed that the application of an aqueous solution of proline or threonine gives the possibility:

of reducing the friction coefficient as compared with a untreated coated metal sheet with such a solution (control), and/or of avoiding a friction with jerking or grazing ("stick slip"), while at certain pressures, grazing is observed for a coated metal sheet not treated with such a solution (control), of retaining the improved tribological properties, even when the treated coated metal sheet has undergone a washing/re-oiling treatment.

TABLE 3

Tribological properties (Observation of grazing and a friction coefficient (μ) versus the exerted pressure) for the tested metal sheet samples.

| Metal sheet | Oil | | Applied aqueous solution: Amino acid (nature) | Concentration of amino acid (g/L) | pH of the aqueous solution | Pressure (MPa) at which grazing is observed | Friction coefficient (μ) at 40 MPa | at 60 MPa | at 80 MPa |
|---|---|---|---|---|---|---|---|---|---|
| GI | Fuchs ® 3802-39S | A | None (control) | NA | NA | 21 | 0.180 | 0.190 | 0.200 |
| | | | Proline | 50 | 6.3 | NA | 0.145 | 0.160 | 0.150 |
| | | | | 100 | 6.3 | NA | 0.120 | 0.120 | 0.105 |
| | | | | 150 | 6.3 | NA | 0.110 | 0.105 | 0.105 |
| | | | Threonine | 20 | 5.6 | NA | 0.130 | 0.155 | 0.140 |
| | | | | 50 | 5.6 | NA | 0.110 | 0.110 | 0.100 |
| | | | | 80 | 5.6 | NA | 0.110 | 0.100 | 0.090 |
| | | | | 100 | 5.6 | NA | 0.115 | 0.110 | 0.100 |
| GI | | C | None(control) | NA | NA | 18 | 0.18 | 0.19 | 0.17 |
| | | | Proline | 80 | 4.0* | NA | 0.13 | 0.13 | 0.12 |
| | | | Proline** | 80 | 4.0* | NA | 0.14 | 0.14 | 0.13 |
| EG DC06 | | | None(control) | NA | NA | 43 | 0.170 | 0.200 | 0.190 |
| | | | Proline | 50 | Natural | NA | 0.120 | 0.120 | 0.120 |
| | | | Threonine | 20 | natural | NA | 0.125 | 0.125 | 0.110 |
| EG DC06 | Quaker | | None(control) | NA | NA | 18 | 0.19 | 0.16 | 0.14 |
| | | | Proline | 70 | natural | NA | 0.15 | 0.12 | 0.11 |
| Fortiform | | | None(control) | NA | NA | NA | 0.18 | 0.15 | 0.13 |
| | | | Proline | 70 | natural | NA | 0.13 | 0.12 | 0.11 |
| Zn JVD | Fuchs ® 4107S | A | None(control) | NA | NA | NA | 0.25 | 0.22 | 0.18 |
| | | | Proline | 10 | natural | NA | 0.24 | 0.20 | 0.17 |
| | | | Proline | 20 | natural | NA | 0.20 | 0.17 | 0.14 |
| | | B | None(control) | NA | NA | NA | 0.27 | 0.23 | 0.20 |
| | | | Proline | 10 | natural | NA | 0.24 | 0.20 | 0.17 |
| | | | Proline | 20 | natural | NA | 0.20 | 0.17 | 0.14 |
| | | | Proline | 70 | natural | NA | 0.14 | 0.12 | 0.10 |
| | Quaker | A | None(control) | NA | NA | NA | 0.26 | 0.23 | 0.20 |
| | | | Proline | 10 | natural | NA | 0.25 | 0.20 | 0.18 |
| | | | Proline | 20 | natural | NA | 0.20 | 0.17 | 0.15 |
| | | B | None(control) | NA | NA | NA | 0.26 | 0.23 | 0.20 |
| | | | Proline | 10 | natural | NA | 0.25 | 0.20 | 0.18 |
| | | | Proline | 20 | natural | NA | 0.20 | 0.17 | 0.15 |
| | | | Proline | 70 | natural | NA | 0.14 | 0.12 | 0.10 |

EG: electro-zinc-plated substrate
*pH adjusted by adding $H_3PO_4$
**test after having undergone a washing/re-oiling treatment

What is claimed is:

1. A coated metal sheet comprising:

a steel substrate;

a metal coating on at least one face of the steel substrate, the metal coating comprising at least 40% by weight of zinc; and a layer coating an outer surface of the metal coating, the layer consisting of:

an amino acid in a neutral or salt form, the amino acid being selected from among alanine, arginine, aspartic acid, cysteine, glutamine, lysine, methionine, proline, serine, threonine, or of a mixture thereof, the amount of said amino acid or of said mixture being from 0.1 to 200 mg/m$^2$, and optionally a base or a mixture of bases, or an acid or a mixture of acids.

2. The coated metal sheet according to claim 1, wherein the amino acid is proline in the neutral or salt form, threonine in the neutral or salt form, or a mixture of proline and of threonine, the proline and the threonine being in the neutral or salt form.

3. The coated metal sheet according to claim 1, wherein the amount of said amino acid or of said mixture is from 25 to 150 mg/m$^2$.

4. The coated metal sheet according to claim 3, wherein the amount of said amino acid or of said mixture being from 50 to 100 mg/m$^2$.

5. The coated metal sheet according to claim 1, wherein a mass percentage of dry extract of the amino acid in a neutral or salt form or of the mixture of amino acids in neutral or salt forms in the layer is greater than or equal to 50%.

6. The coated metal sheet according to claim 1, wherein a molar percentage of dry extract of the amino acid in a neutral or salt form in the layer is greater than or equal to 50%.

7. The coated metal sheet according to claim 1, wherein the amino acid is selected from among alanine, aspartic acid, cysteine, glutamine, methionine, proline, serine, threonine, and a mixture thereof, each amino acid being in a neutral or salt form.

8. The coated metal sheet according to claim 1, wherein the amino acid is selected from among proline in neutral or salt form, cysteine in neutral or salt form, and a mixture thereof.

9. A metal sheet obtained by a method comprising at least the steps of:

providing a steel substrate, at least one face of which is coated with a metal coating comprising at least 40% by weight of zinc, applying on the outer surface of the metal coating an aqueous solution consisting of:

water;

an amino acid selected from the group consisting of neutral and salts forms of alanine, arginine, aspartic acid, cysteine, glutamine, lysine, methionine, proline, serine, threonine, and mixtures thereof, and optionally a base or a mixture of bases, or an acid or a mixture of acids;

wherein the aqueous solution is free of any compound comprising a metal from the group IIIB or from the group IVB and the mass percentage as a dry extract of the amino acid in neutral or salt form or of the mixture of amino acids in neutral or salt forms in the aqueous solution is greater than or equal to 75%, wherein at least one portion of at least one outer surface of the metal coating is coated with a layer comprising from 0.1 to 200 $mg/m^2$ of said amino acid in the neutral or salt form or of a mixture of said amino acids in the neutral or salt forms.

10. The metal sheet according to claim 9, wherein the metal coating is a zinc and magnesium alloy comprising between 0.1 and 10% by weight of Mg.

11. The metal sheet according to claim 9, wherein the metal coating further comprises between 0.1 and 20% by weight of Al.

12. The metal sheet according to claim 11, wherein the metal coating further comprises one or more elements selected from the group consisting of Si, Sb, Pb, Ti, Ca, Mn, Sn, La, Ce, Cr, Ni, and Bi.

13. The metal sheet according to claim 9, wherein the steel substrate at least one face of which is coated with a metal coating is a hot galvanized steel substrate.

14. The metal sheet according to claim 9, wherein the amino acid is proline in the neutral or salt form, threonine in the neutral or salt form, or a mixture of proline and of threonine, the proline and the threonine being in the neutral or salt form.

15. The metal sheet according to claim 9, wherein the aqueous solution comprises from 1 to 200 g/L of said amino acid.

16. The metal sheet according to claim 9, wherein the mass percentage in dry extract of the amino acid in the neutral or salt form or of the mixture of amino acids in the neutral or salt forms in the aqueous solution is greater than or equal to 90%.

17. The metal sheet according to claim 9, wherein the aqueous solution has a pH comprised between a pH equal to [isoelectric point of the amino acid−3] and a pH equal to the [isoelectric point of the amino acid+1].

18. A metal sheet obtained by a method comprising at least the steps of:

providing a steel substrate, at least one face of which is coated with a metal coating comprising at least 40% by weight of zinc, applying on the outer surface of the metal coating an aqueous solution consisting of:

water;

an amino acid selected from the group consisting of neutral and salts forms of alanine, arginine, aspartic acid, cysteine, glutamine, lysine, methionine, proline, serine, threonine, and mixtures thereof, and optionally a base or a mixture of bases, or an acid or a mixture of acids;

wherein the aqueous solution is free of any compound comprising a metal from the group IIIB or from the group IVB and the mass percentage as a dry extract of the amino acid in neutral or salt form or of the mixture of amino acids in neutral or salt forms in the aqueous solution is greater than or equal to 75%, wherein the steel substrate at least one face of which is coated with a metal coating is a hot galvanized steel substrate.

* * * * *